US006964094B2

(12) United States Patent
Kondo

(10) Patent No.: US 6,964,094 B2
(45) Date of Patent: Nov. 15, 2005

(54) DIE CHANGING MECHANISM FOR SELF-PIERCING RIVET SETTING APPARATUS AND THE LIKE

(75) Inventor: Yoshiteru Kondo, Toyohashi (JP)

(73) Assignee: Newfrey LLC, Newark, DE (US)

( * ) Notice: Subject to any disclaimer, the term of this patent is extended or adjusted under 35 U.S.C. 154(b) by 321 days.

(21) Appl. No.: 10/445,892

(22) Filed: May 28, 2003

(65) Prior Publication Data

US 2004/0060958 A1 Apr. 1, 2004

(30) Foreign Application Priority Data

May 31, 2002 (JP) ..... 2002-160054

(51) Int. Cl.[7] ..... B23P 19/00
(52) U.S. Cl. ..... 29/798; 29/243.53; 29/432.2
(58) Field of Search ..... 29/798, 243.53, 29/432.1, 432.2, 524.1, 715, 788, 796

(56) References Cited

U.S. PATENT DOCUMENTS

| | | | | |
|---|---|---|---|---|
| 533,195 | A | 1/1895 | Hays | |
| 1,203,124 | A | 10/1916 | Lyon | |
| 1,850,671 | A | 3/1932 | Havener | |
| 2,257,379 | A | 9/1941 | Havener | |
| 3,611,773 | A | 10/1971 | Gerth | |
| 4,047,281 | A | 9/1977 | Di Maio et al. | |
| 4,312,107 | A | 1/1982 | White | |
| 5,218,756 | A | 6/1993 | Zaleski | |
| 5,722,144 | A * | 3/1998 | Bora | 29/402.05 |
| 6,092,275 | A | 7/2000 | Kellner et al. | |
| 6,161,279 | A * | 12/2000 | Suboski | 29/798 |
| 6,237,212 | B1 | 5/2001 | Speller, Jr. et al. | |
| 6,240,332 | B1 | 5/2001 | Buttrick et al. | |
| 2001/0016973 | A1 | 8/2001 | Speller, Jr. et al. | |
| 2002/0014102 | A1 | 2/2002 | Kondo et al. | |
| 2002/0029450 | A1 | 3/2002 | Kondo | |
| 2003/0046804 | A1 | 3/2003 | Donovan | |
| 2004/0216304 | A1 * | 11/2004 | Naito | 29/798 |
| 2004/0261259 | A1 * | 12/2004 | Naito | 29/798 |

FOREIGN PATENT DOCUMENTS

| | | |
|---|---|---|
| WO | WO 94/14554 | 7/1994 |

* cited by examiner

*Primary Examiner*—David P. Bryant
(74) *Attorney, Agent, or Firm*—Miles & Stockbridge P.C.

(57) ABSTRACT

An apparatus comprises a die assembly including a plurality of dies held on a movable table, and a driving device for moving the die assembly. The driving device is operable to move the die assembly in a direction transverse to the axis of a punch for allowing one of the dies to be placed in a position located axially below the punch. The driving device is also operable to move the die assembly in the axial direction of the punch between raised and lowered positions. In the raised position, the die assembly can be moved by the driving device to place a selected die below the punch. In the lowered position, the selected die can be fixed in a die mounting hole located below the punch. In this position, the punch is operable to join workpieces by riveting, for example.

12 Claims, 7 Drawing Sheets

FIG. 7
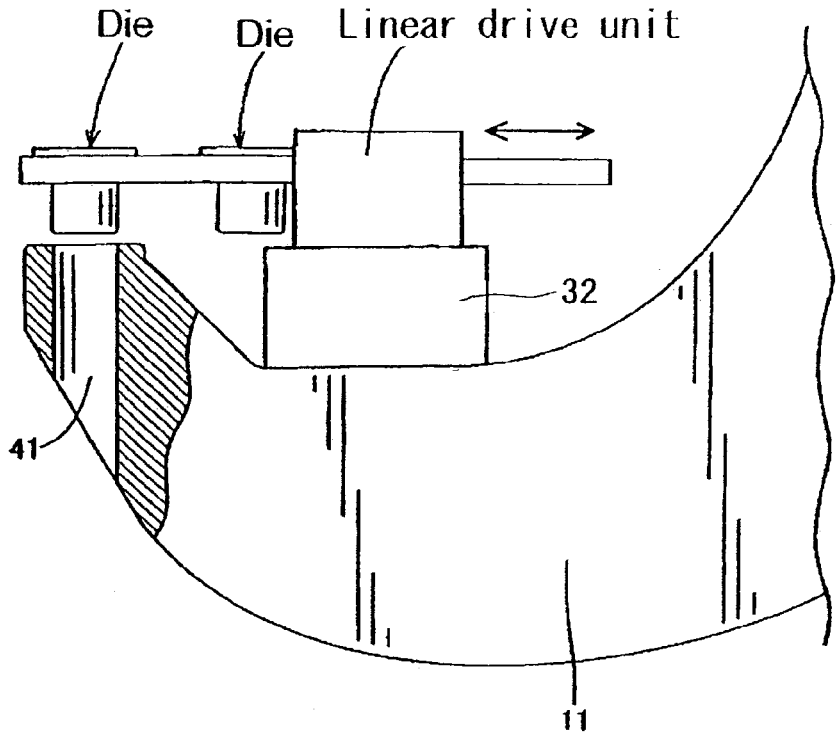
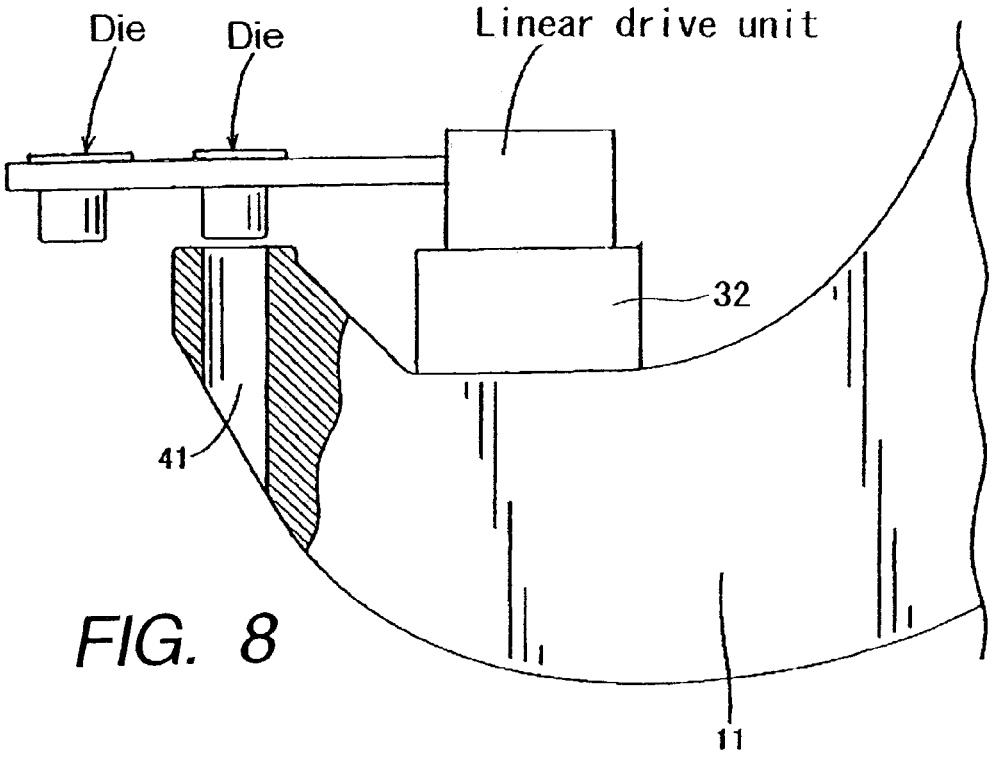
FIG. 8

DIE CHANGING MECHANISM FOR SELF-PIERCING RIVET SETTING APPARATUS AND THE LIKE

CROSS REFERENCE TO RELATED APPLICATION

This application claims the benefit of Japanese Patent Application No. 2002-160054 filed May 31, 2002, incorporated herein by reference.

BACKGROUND OF THE INVENTION

The present invention is concerned with a mechanism for changing dies used in an apparatus for joining workpieces and is more particularly concerned with a self-piercing rivet setting apparatus.

In order to comply with the demand for weight reduction in transport apparatuses or the like, aluminum alloy components have been increasingly employed. Generally, a welding process is not suitable for aluminum panels of automobiles or the like, and such panels are typically fastened together using self-piercing rivets. Particularly in a body assembling operation for automobiles or the like (more particularly in an assembling operation of an aluminum body), self-piercing rivets are used to fasten two or more sheet members (or a sheet member and another component) together.

One example of a self-piercing rivet setting apparatus is disclosed in Japanese Patent Laid-Open Publication No. H 08-505087. A self-piercing rivet may comprise a large diameter head (hereinafter, "large head") and a hollow leg extending downward from the head. When the self-piercing rivet is driven into a pair of workpieces, the front end of the leg is expandingly deformed while piercing the workpieces, and the workpieces are finally fastened together by the deformed leg and the large head.

The self-piercing rivet may be driven into workpieces to penetrate through a punch-side workpiece but to stay in a die-side workpiece adjacent to a die without penetrating therethrough. Thus, after the rivet setting operation, no opening is formed in the surface of the die-side workpiece. This provides an advantage of preventing deterioration in sealing performance of a workpiece while maintaining good appearance thereof.

FIG. 1 is a sectional view showing a connected region of a pair of workpieces fastened by a conventional self-piercing rivet. The self-piercing rivet comprises a large head 5 and a hollow leg 6 extending downward from the head. The self-piercing rivet is driven into a pair of workpieces 2, 3 by a punch and a die of a rivet setting apparatus (not shown). During the rivet setting operation, the leg 6 is deformed to allow the front end thereof to be expanded while piercing the workpieces (body panels or the like). As a result, the punch-side workpiece 2 and the die-side workpiece 3 are fastened together by the deformed leg 6 and the large head 5. More specifically, the pair of workpieces 2, 3 are fastened together by way of an undercut 7 formed by the leg 6 of the rivet expanded in the lateral direction of the die-side workpiece 3 (or the radially outward direction of the rivet).

The size or dimensions of the rivet may vary depending on the thickness and/or material of workpieces to be fastened. A die to be used in a rivet setting operation for fastening workpieces may need to be changed depending on the thickness and/or material of the workpieces and/or the dimensions of the rivet. When a different die is used, the rivet setting condition for obtaining an optimal undercut may be changed.

Heretofore, in a rivet setting operation for different workpieces, one rivet setting apparatus has been exchanged with another rivet setting apparatus having a different die mounted thereon, or one rivet setting apparatus has been used by substituting one die with another suitable die.

When different rivet setting apparatuses are used, it is necessary to provide a plurality of rivet setting apparatuses suitable for different rivet setting conditions and to transfer workpieces to the respective locations of these apparatuses. As a result, the use of a plurality of rivet setting apparatuses leads to increased equipment cost, expanded installation space and extended time for rivet setting operations. When die substitution is used, it is necessary to change dies in the apparatus frequently, which increases the time needed for riveting operations.

BRIEF DESCRIPTION OF THE INVENTION

In view of the above problems, it is an object of the present invention to provide a rivet setting apparatus capable of changing dies for rivet setting operations, thereby enhancing productivity, for example in an assembly line for automobile bodies or the like.

Another object of the present invention is to provide an improved mechanism for changing dies used in an apparatus for joining workpieces.

A self-piercing rivet setting apparatus in accordance with one embodiment of the invention comprises a die assembly including a movable table and a plurality of dies, and a driving device for moving the die assembly in a first direction transverse to the axis of a punch and in a second direction axially of the punch and perpendicular to the table.

Movement of the die assembly in the direction transverse to the axis of the punch allows one of the plurality of dies to be moved to a position axially aligned with the punch. Movement of the die assembly axially of the punch is in a range between a lifted position and a lowered position of the die assembly. In the lifted position, a driving device is allowed to move the die assembly in the direction transverse to the axis of the punch. In the lowered position, the driving device is prevented from moving the die assembly in the direction transverse to the axis of the punch, and the selected die is fixed in axial alignment with the punch. In the lowered position of the die assembly, the punch is operable to drive a rivet into workpieces and fasten them together.

The die assembly includes a plurality of dies, e.g., three or more dies. The movable table may be a rotary table having a disk shape, with the plurality of dies mounted in a circular array along the periphery of the movable table, and the driving device may be operable to rotate the die assembly so as to move the dies in the direction transverse to the axis of the punch. The driving device may include a rotary motor. Alternatively, the plurality of dies may be mounted on a reciprocating table in a linear array. In this case, the driving device may be operable to move the die assembly linearly so as to displace the dies in the direction transverse to the axis of the punch. The driving device may include a linear motor.

The self-piercing rivet setting apparatus may be adapted to select one of the dies to be used according to a rivet setting condition. The self-piercing rivet setting apparatus may include a device for detecting the position of the movable table, and the driving device may be controlled automatically or manually.

BRIEF DESCRIPTION OF THE DRAWINGS

The invention will be further described in conjunction with the accompanying drawings, which illustrate preferred (best mode) embodiments, and in which.

Figure 3:
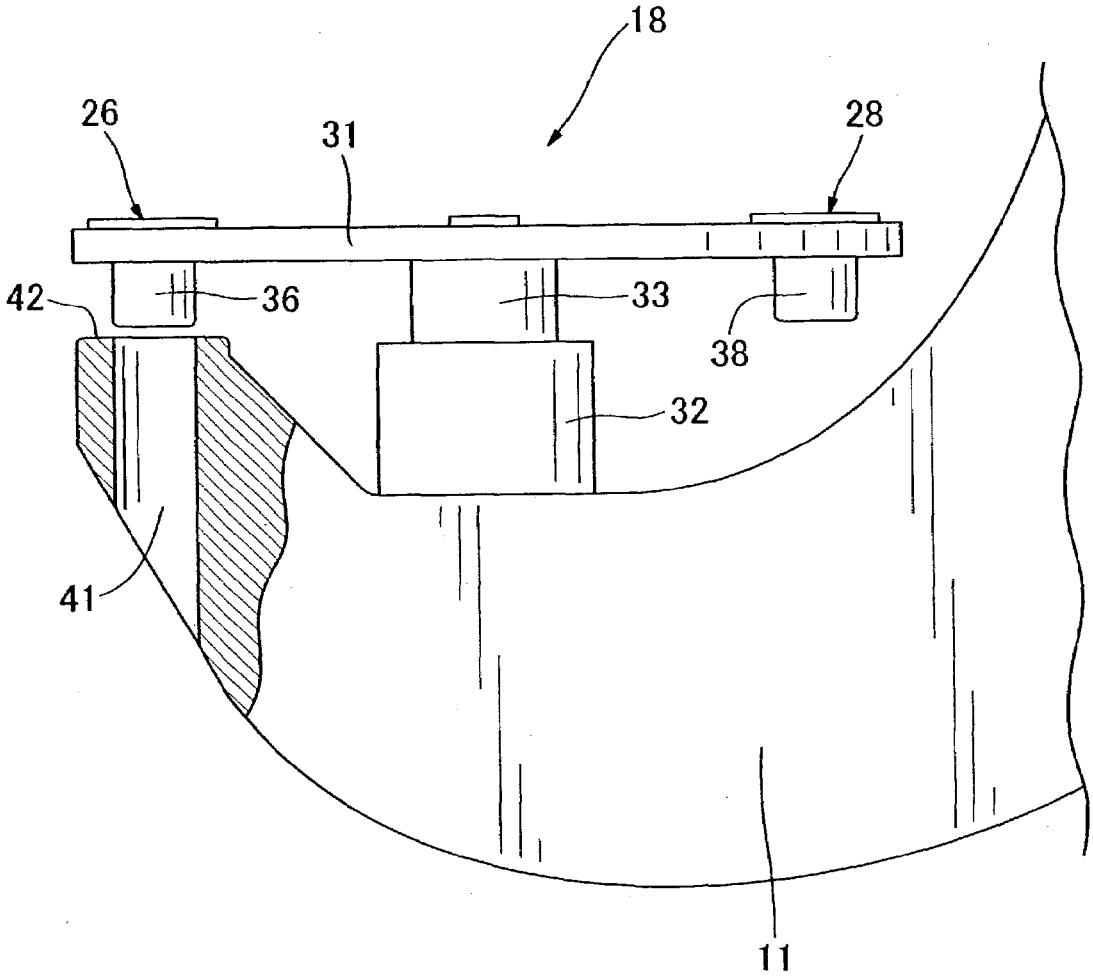
FIG. 3 is an enlarged end view (partial sectional view) showing a C-shaped frame and a die assembly in its lifted position.
Figure 5:
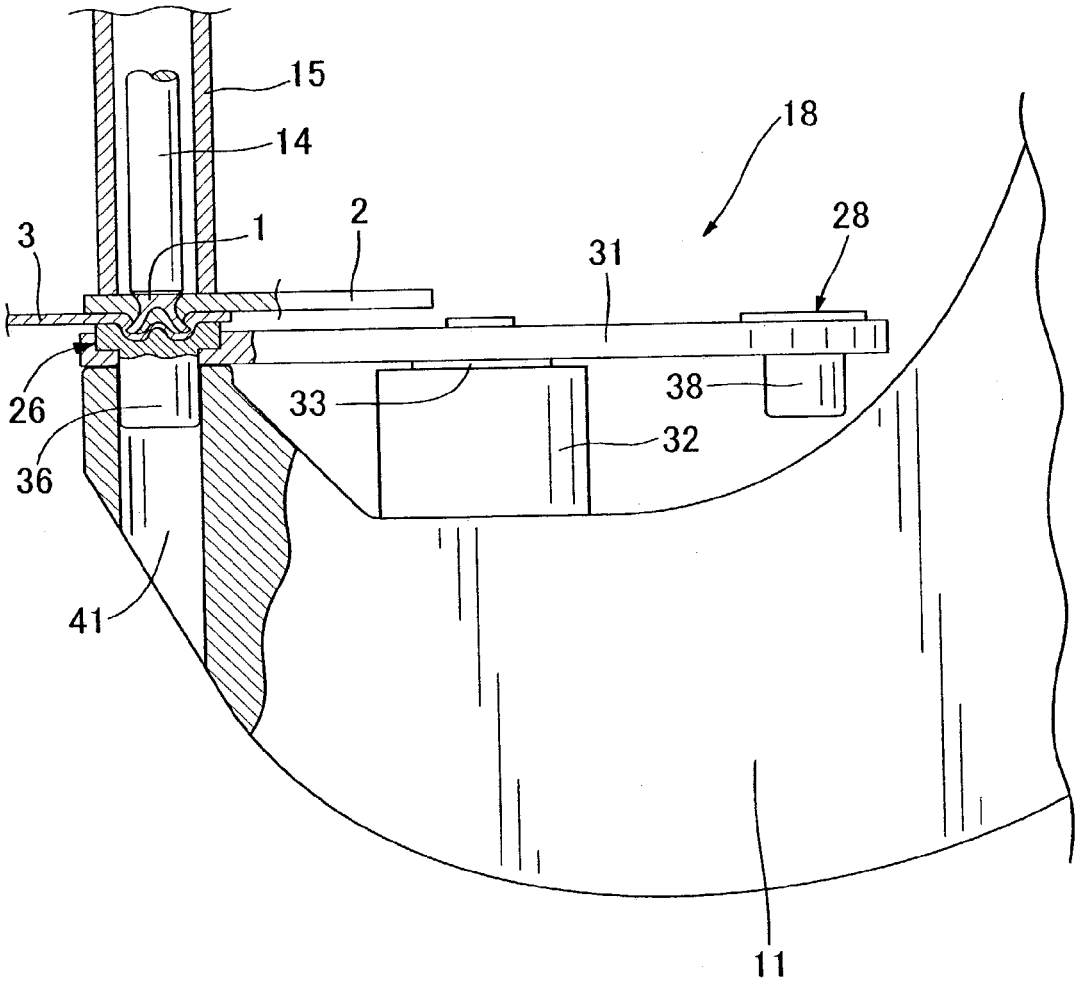
FIG. 5 is an end view (partial sectional view) showing the state after workpieces are fastened together by a rivet.

FIG: 6 is an enlarged view of the region fastened by the rivet in FIG. 5;

FIG. 7 is a view similar to FIG. 3, showing another embodiment; and

FIG. 8 is a view similar to FIG. 7 showing displacement of a die table to a position different from that shown in FIG. 7.

DETAILED DESCRIPTION OF THE INVENTION

Figure 2:
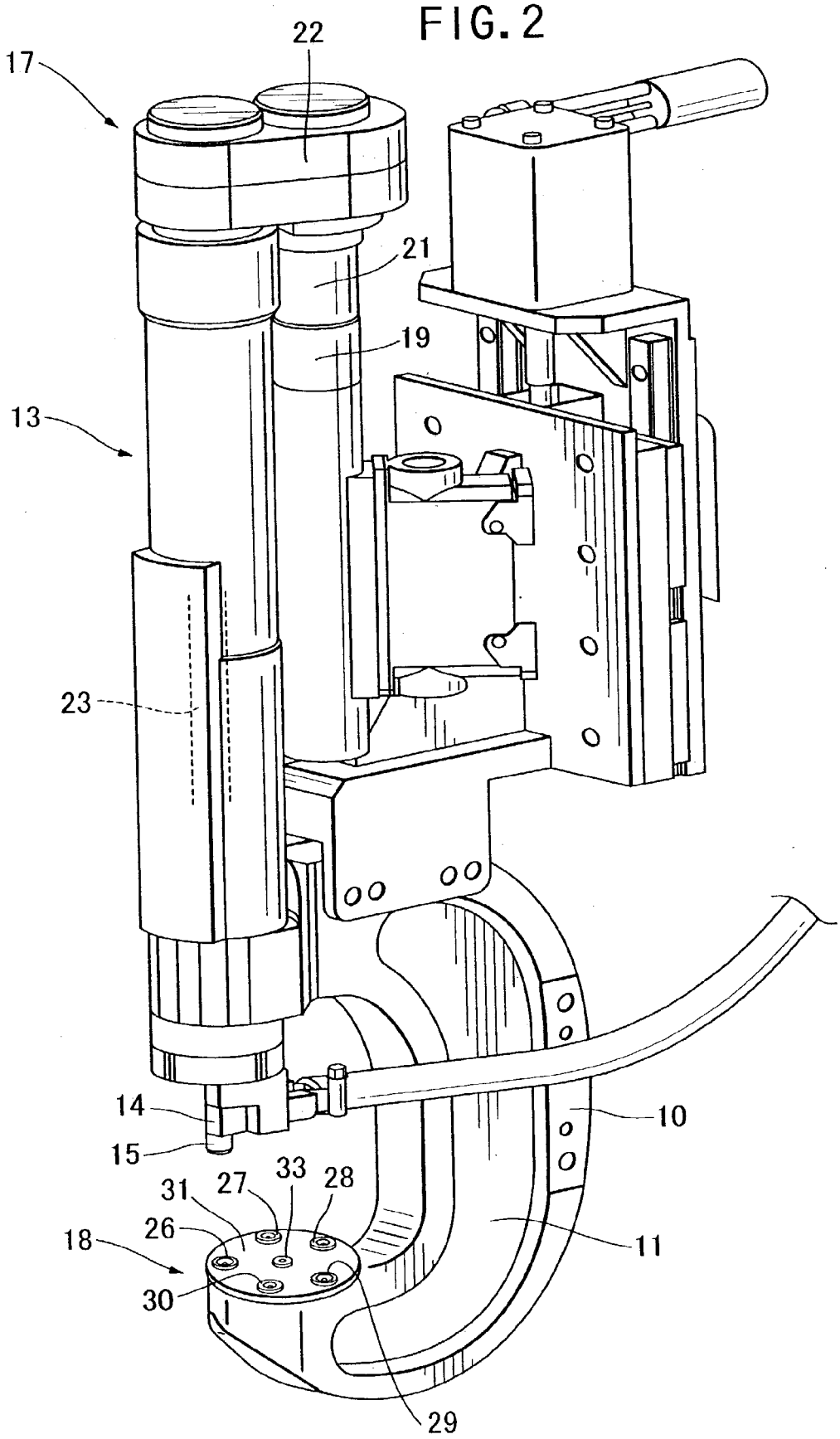
FIG. 2 is a perspective view of a self-piercing rivet setting apparatus according to one embodiment of the present invention.

A self-piercing rivet setting apparatus according to one embodiment of the present invention is shown in FIG. 2, and includes a C-shaped frame 11 having an upper horizontal arm portion, a lower horizontal portion, and a vertical arm portion connecting the upper and lower horizontal portions, the respective portions being integrally formed. The C-shaped frame 11 may be elastically deformed to absorb shocks during a rivet setting operation. The vertical arm portion of the C-shaped frame 11 may include a coupling region 10 to be coupled with an articulated robot arm (not shown).

A setting mechanism 13 of the self-piercing rivet setting apparatus is attached to one end of the upper horizontal arm portion. A punch 14 is attached to the lower portion of the setting mechanism 13, the punch being movable vertically in the form shown. A receiver unit 15 for holding a self-piercing rivet is provided at the lower side of the punch 14.

A spindle driving unit 17 is provided on the upper side of the punch 14. The spindle driving unit 17 may comprise an electric driving motor 19, a reduction gear mechanism 21 for transmitting a rotational force of the motor, a gear mechanism 22, and a spindle 23 which is driven by the gear mechanism and adapted to move vertically while rotating. The setting mechanism 13 is adapted to push the punch 14 downward to allow the self-piercing rivet held by the receiver unit 15 located on the lower side of the punch to be driven into workpieces held on a die assembly 18 attached at one end of the lower horizontal arm portion of the C-shaped frame 11.

In one embodiment of the present invention, the die assembly 18 includes a movable table 31, a plurality of dies on the movable table 31, and a shaft 33 attached at the center of the movable table. The movable table 31 is formed as a disk-shaped flat plate, and is controllably rotated around the axis of the center shaft. In the embodiment illustrated in FIG. 2, five dies 26, 27, 28, 29, 30 are mounted on the movable table 31 in a circular array along the periphery of the table. Each of the dies includes a cavity having a different shape and conforming to a rivet setting condition in each rivet setting operation for fastening various types of workpieces. The movable table 31 is adapted to be rotated so as to allow the desired one of the dies 26, 27, 28, 29, 30 to be selectively located at the position immediately below the punch 14.

Figure 1:
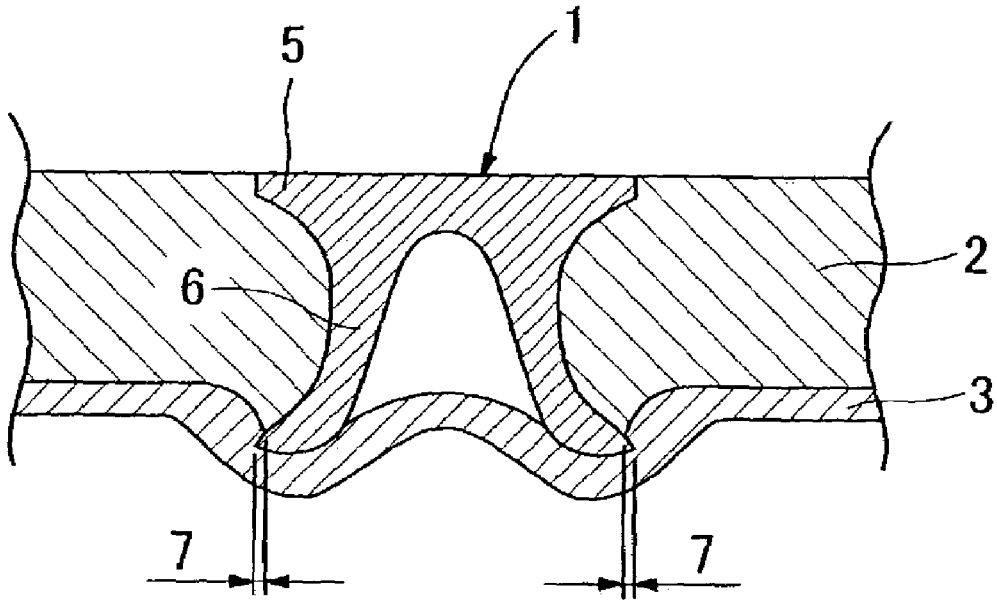
FIG. 1 is a sectional view showing a state after a self-piercing rivet is driven into workpieces by a rivet setting apparatus.

Upon activation of the electric driving motor 19, the spindle 23 is vertically moved, and the punch 14 is moved by the spindle to push a self-piercing rivet held by the receiver unit 15 toward the die 26, for example. A plurality of workpieces (e.g. the workpieces 2, 3 in FIG. 1) are placed on the die assembly 18. As the punch 14 is lowered, the self-piercing rivet gradually pierces the workpieces. As a result, the plurality of workpieces will be fastened together.

Figure 4:
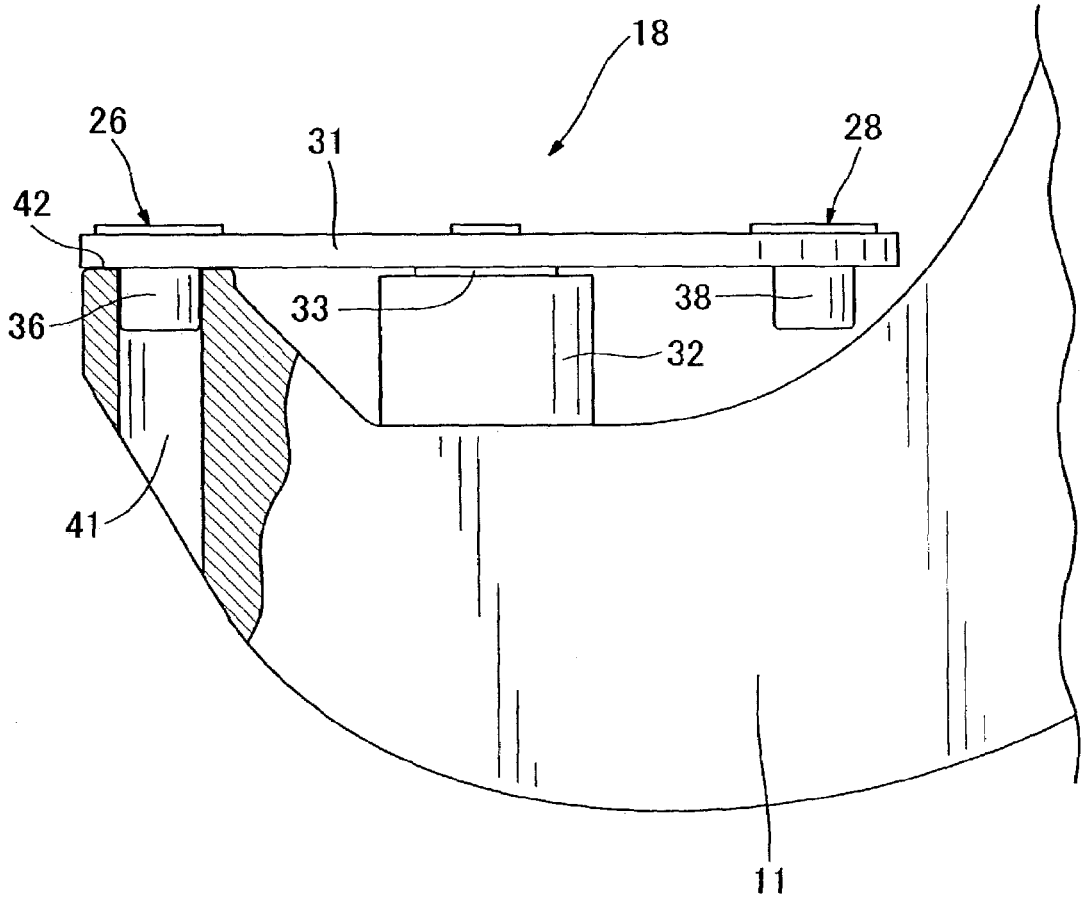
FIG. 4 is an enlarged end view (partial sectional view) showing the C-shaped frame and the die assembly in its lowered position.

FIGS. 3 and 4 are enlarged end views (partial sectional views) showing the lower portion of the C-shaped frame and the die assembly 18. In FIG. 3, the die assembly is in a lifted position. In the lifted position, the movable table 31 can be rotated in a direction transverse to the axis of the punch. FIG. 4 shows the die assembly 18 in a lowered position. In the lowered position, the movable table 31 is precluded from rotational movement, and the rivet is driven while the die assembly is in the lowered position.

FIG. 3 shows the state after the die assembly 18 having the dies 26, 27, 28, 29, 30 mounted on the movable table 31 is lifted and rotated to allow one selected die 26 to be located below the punch (not shown).

A driving device 32 provided in the C-shaped frame 11 is operable to move the shaft 33 vertically (in the axial direction of the punch) for allowing the die assembly 18 to be moved vertically (in a direction perpendicular to the table 31). The driving device 32 includes a lifting mechanism for vertically moving the die assembly. The lifting mechanism includes an electromagnet or solenoid, for example, and is operable to energize the electromagnet in a direction to move the movable table 31 upward to the lifted position. The electromagnet may be energized in an opposite direction to move the movable table 31 downward to the lowered position, or the electromagnet may be de-energized to allow the table 31 to be moved downward to the lowered position by a return spring, for example.

In the lifted position of the die assembly 18 as shown in FIG. 3, the driving device is allowed to rotate the shaft 33 and the die assembly 18. The driving device 32 further includes a servomotor, for example, for rotating the die assembly 18 and may also include a detecting device, e.g., an encoder, for detecting the rotational position of the die assembly 18. The servomotor is adapted to rotate table 31 while detecting the rotational position of the table 31 by means of the encoder so as to accurately move the rotatable table to a given rotational position.

In one embodiment of the present invention, the self-piercing rivet setting apparatus is adapted to automatically select a desired die according to a rivet setting condition, which may determine a control signal to the driving device 32 instructing the driving device to move a particular die into alignment with the axis of the punch. The relationship between the respective dies and corresponding rivet setting conditions, such as the thickness and/or material of workpieces to be fastened, can be determined in advance and stored to control the selection of particular dies automatically. Alternatively, an operator may control the driving device manually to select a desired die.

As shown in FIGS. 3 and 4, the lower portion of the die 26 is formed as a column-like shank 36, and the lower portion of the die 28 is formed as a column-like shank 38. The lower portion of each of the other dies is also formed as a column-like shank. The shanks of the dies all have the same shape. The lower portion of the C-shaped frame 11 is formed with a die mounting hole 41 for receiving a shank, e.g., 36 or 38, therein. The inner diameter of the die mounting hole 41 is set in conformity with the outer diameter of each shank so as to allow the die mounting hole 41 to receive and hold each shank at a given rivet setting position.

FIG. 4 shows the state after the die assembly 18 is moved downward to the lowered position, and the shank 36 of the die 26 is inserted into the die mounting hole 41 formed in the lower portion of the C-shaped frame. The bottom surface of the movable table 31 is in contact with a receiving surface 42 around the upper end of the die mounting hole 41. In this state, the die 26 is fixed to the C-shaped frame 11, and the workpieces to be joined are placed on the die assembly and clamped between the receiver 15 and the die 26.

Figure 6:
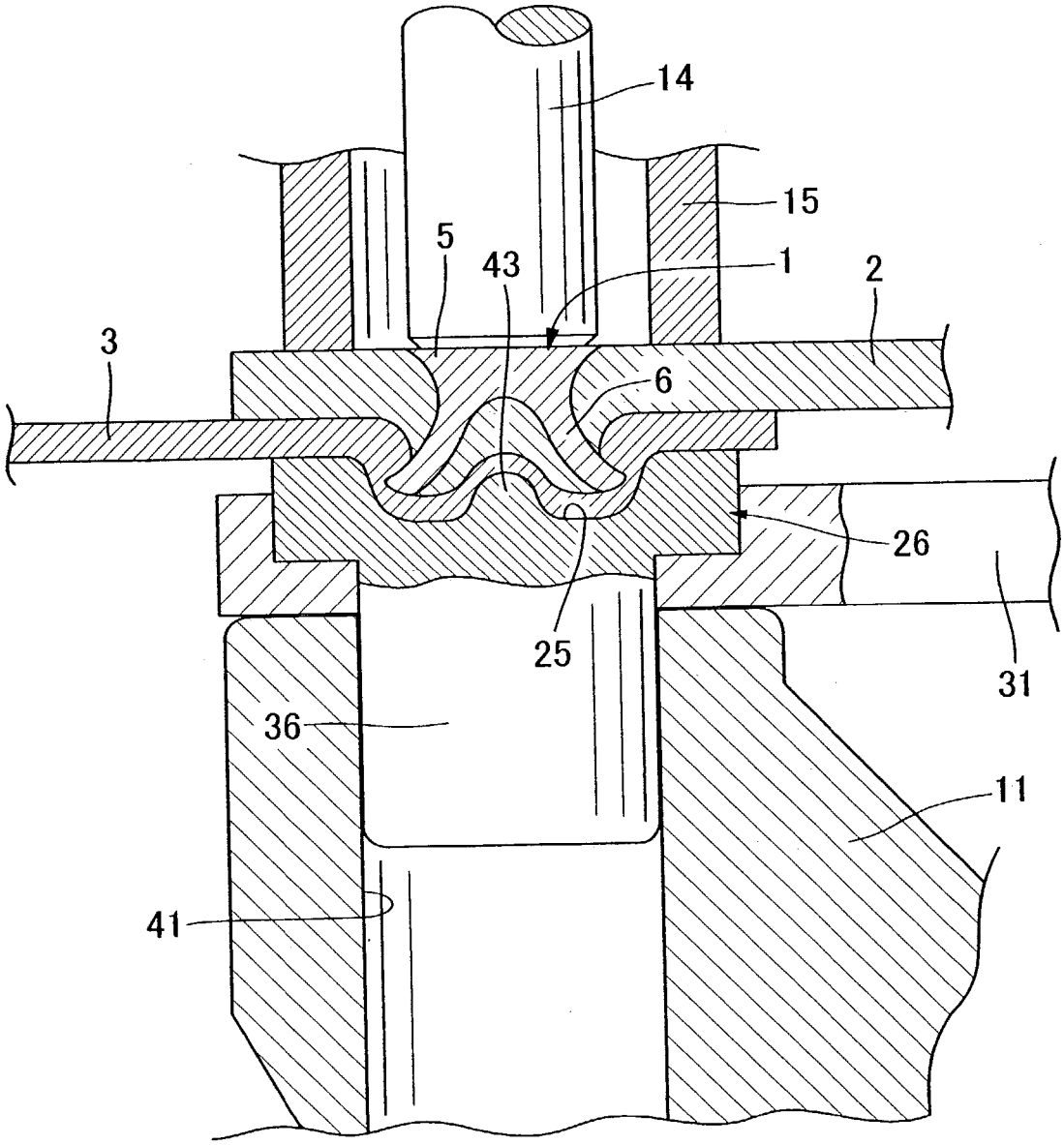

FIG. 5 is an end view (partial sectional view) showing the state after the workpieces 2, 3 are fastened together. FIG. 6 is a fragmentary enlarged view of the region fastened by a rivet 1 in FIG. 5.

The die 26 includes a cavity 25 having a bottom surface formed with a protrusion 43 at the center thereof. Other dies may have similar protrusions. The leg of the rivet is expanded in a radially outward direction by the protrusion 43. The cavity of each die may be formed as an approximately flat surface, for example. The shape of the cavity of the die in FIG. 6 is simply shown as one example, and the present invention is not limited to such a shape.

As shown in FIGS. 5 and 6, the punch 14 drives the rivet 1 into the workpieces 2, 3 while the workpieces 2, 3 are clamped between the receiver unit 15 at one side of the workpieces and the die 26 at the opposite side of the workpieces. The leg of the rivet 1 is deformed by the protrusion 43 formed at the center of the cavity 25 while piercing the workpieces 2, 3, to allow the front end of the leg to be expanded in a radially outward direction and to stay in the workpieces without penetrating therethrough. As a result, the workpieces 2, 3 are fastened by the expanded leg and the head of the rivet 1.

In advance of the rivet setting operation, the driving device 32 rotates the die assembly 18 in the lifted position to allow a desired die to be rotated to the position below the punch 14. Then, the driving device 32 moves the die assembly downward to the lowered position to insert the shank of the die into the die mounting hole 41 so that the die is fixed to the C-shaped frame 11.

While the movable table in the above embodiment is a disk shaped table that is rotated, the movable table of the present invention is not so limited. For example, the movable table may be a reciprocating table formed in a rectangular shape. In this case, a plurality of dies are mounted on the movable table in a linear array, and a die may be placed below the punch by moving the movable table linearly. FIGS. 7 and 8 illustrate such an embodiment, wherein a plurality of dies are mounted on a rectangular table that can be lifted by the driving device 32 (in a direction perpendicular to the table) and that can be moved rectilinearly (in a direction along the array) by a linear drive unit to place the shank of a selected die over the die mounting hole 41, whereupon the driving device can lower the table to insert the shank of the selected die in the die mounting hole 41, as in the previously described embodiment.

While preferred embodiments of the invention have been shown and described, it will be apparent that changes can be made without departing from the principles and spirit of the invention, the scope of which is defined in the accompanying claims. For example, one or more of the dies may be configured to cooperate with a punch for joining workpieces by clinching instead of riveting.

What is claimed is:

1. An apparatus for driving a self-piercing rivet into a plurality of workpieces for joining the workpieces, comprising:

a punch movable axially to drive a self-piercing rivet;

a die assembly including a movable table with a plurality of dies thereon; and a driving device for moving the die assembly in a first direction to place a selected die in axial alignment with the punch and for moving the die assembly in a second direction between a lifted position and a lowered position of the die assembly, wherein in the lifted position, the driving device is allowed to move the die assembly in the first direction, and in the lowered position, the selected die is fixed in axial alignment with the punch and the driving device is prevented from moving the die assembly in the first direction.

2. The apparatus as defined in claim 1, wherein the table is a rotary table with the plurality of dies arranged in a circular array along the periphery of the table, the first direction is a direction of rotation of the table, and the second direction is a direction perpendicular to the table.

3. The apparatus as defined in claim 1, wherein the table is a reciprocating table with the dies arranged in a linear array on the table, and wherein the first direction is a direction along the array and the second direction is a direction perpendicular to the table.

4. The apparatus as defined in claim 1, wherein the driving device is controlled automatically to select particular dies for alignment with the punch according to rivet setting conditions.

5. The apparatus as defined in claim 1, wherein the driving device is controlled manually.

6. The apparatus as defined in claim 1, wherein each die has a shank that enters a hole in the apparatus to fix the die in alignment with the punch.

7. Apparatus for joining workpieces, comprising:

a punch movable axially and disposed at one side of workpieces to be joined;

a die assembly including a movable table with a plurality of dies thereon; and a driving device for moving the die assembly in a first direction to place a selected die in axial alignment with the punch and for moving the die assembly in a second direction between a lifted position and a lowered position of the die assembly, wherein in the lifted position, the driving device is allowed to move the die assembly in the first direction, and in the lowered position, the selected die is fixed at the opposite side of the workpieces to be joined in alignment with the punch and the driving device is prevented from moving the die assembly in the first direction.

8. Apparatus as defined in claim 7, wherein the table is a rotary table with the plurality of dies arranged in a circular array along the periphery of the table, the first direction is a direction of rotation of the table, and the second direction is a direction perpendicular to the table.

9. Apparatus as defined in claim 7, wherein the table is a reciprocating table with the dies arranged in a linear array on the table, and wherein the first direction is a direction along the array and the second direction is a direction perpendicular to the table.

10. Apparatus as defined in claim 7, wherein the driving device is controlled automatically to select particular dies for alignment with the punch.

11. Apparatus as defined in claim 7, wherein the driving device is controlled manually.

12. Apparatus as defined in claim 7, wherein each die has a shank that enters a hole in the apparatus to fix the die in alignment with the punch.

* * * * *